United States Patent [19]

Popik

[11] Patent Number: 4,727,927

[45] Date of Patent: Mar. 1, 1988

[54] CASTING MACHINE CONTROL

[75] Inventor: Stephen E. Popik, Riverside, Calif.

[73] Assignee: Hunter Engineering Company, Inc., Riverside, Calif.

[21] Appl. No.: 5,446

[22] Filed: Jan. 20, 1987

[51] Int. Cl.[4] ..... B22D 11/06; B22D 11/16

[52] U.S. Cl. ..... 164/452; 164/480; 164/428; 164/154

[58] Field of Search ..... 164/480, 428, 154, 452

[56] References Cited

U.S. PATENT DOCUMENTS

| | | | |
|---|---|---|---|
| 2,824,346 | 1/1958 | Osborn | 22/57.2 |
| 3,478,808 | 11/1969 | Adams | 164/4 |
| 3,869,891 | 3/1975 | Higham | 72/8 |
| 4,054,173 | 10/1977 | Hickam | 164/423 |
| 4,162,699 | 7/1979 | Mairy | 164/4 |
| 4,497,360 | 2/1985 | Bercovici | 164/454 |
| 4,501,315 | 2/1985 | Bercovici | 164/454 |
| 4,559,990 | 12/1985 | Grellinger | 164/428 |

FOREIGN PATENT DOCUMENTS

| | | |
|---|---|---|
| 2736659 | 2/1979 | Fed. Rep. of Germany . |
| 3230363A1 | 8/1982 | Fed. Rep. of Germany . |
| 755623 | 11/1933 | France . |
| 866139 | 6/1941 | France . |
| 1329801 | 12/1963 | France . |
| 2002274 | 2/1979 | United Kingdom . |

OTHER PUBLICATIONS

"Continuous Casting", 1974, Heco, 8 pages.

"Casting and Rolling of Non-Ferrous Metals: Krupp-A Company with all the Experience in Top Technology and Plantmaking"; Krupp, pp. 1 to 16, Federal Republic of Germany.

"Alusuisse Caster I—Continuous Strip Casting Equipment"; Alusuisse; 15 pages; Swiss Aluminum Ltd. Aluminum Division, Continuous Casting, Zurich, Switzerland.

"Krupp Compact Caster For Aluminum Re-Roll Stock"; Krupp; Federal Republic of Germany; 5 pages.

*Primary Examiner*—Kuang Y. Lin

*Attorney, Agent, or Firm*—Christie, Parker & Hale

[57] ABSTRACT

A dual drive sheet casting machine for casting metal sheet has a pair of water cooled rolls between which the metal is cast. Each roll of the casting machine is driven by a separate motor, with one motor being a master and the other a slave driven at a controlled percentage of the speed or current of the master motor. Differential current to the two motors indicates sticking or microsticking of metal to the rolls. When the magnitude of the differential current exceeds a high limit indicating sticking, the master roll is slowed to eliminate the sticking. When the magnitude of differential current passed by a band pass filter between one half and ten Hertz exceeds a selected maximum indicating microsticking, the rotational speed of the master roll is decreased. After making a change in roll speed, the control circuit is disabled for an interval to permit the casting machine to regain stability.

35 Claims, 2 Drawing Figures

CASTING MACHINE CONTROL

BACKGROUND OF THE INVENTION

This invention concerns control of a continuous roll caster of a type commonly used for casting aluminum base alloys. One type of roll casting machine is described in U.S. Pat. No. 4,054,173 by Hickam, the subject matter of which is hereby incorporated by reference.

In such an apparatus a pair of water cooled parallel casting rolls are positioned one above the other. These rolls are spaced apart a distance corresponding to the thickness of a sheet being cast. A pouring tip fits snugly into the converging space between the casting rolls on the entrance side for introducing molten metal into the nip of the rolls. In an exemplary caster each of the rolls is about 1 meter in diameter and they have a length in the order of 1.5 to 1.8 meters.

Preferably the plane in which the rolls axes lie is not vertical, but instead is tilted backward by about 15 degrees. That is, the plane is tilted so that the upper roll is about 15 degrees nearer the entrance side than the lower roll. The metal thus tends to move somewhat upwardly into the nip of the rolls. This is referred to as a tilt caster. A so called horizontal caster has the rolls in a vertical plane with metal flowing horizontally into the nip of the rolls. Other casters for aluminum have the rolls in a horizontal plane with metal flowing vertically into the rolls.

The rolls are motor driven so that a cast sheet is extruded from the exit side of the casting machine. Typically, this sheet is conveyed to a coiler that forms a tight coil of sheet for transport to subsequent processing. The rolls are rotated slowly so that sheet is cast at a rate less than about two meters per minute.

Some roll casting machines are made with a single motor driving the two rolls in synchronism with each other. This requires that the rolls have carefully proportioned diameters to maintain the desired proportionality of surface speed of the two rolls. The two rolls must turn at almost the same speed to successfully cast flat sheet.

Some roll casting machines are made with separate motor drives for each of the two rolls. This permits independent speed control of the two rolls so that different roll diameters can be accommodated. This can be an appreciable economy in maintaining the rolls.

For example, it is commonly observed that the bottom roll in a caster has a greater amount of heat checking and other surface degradation than the top roll. The surface of the cast sheet mirrors the surface condition of the rolls and it is therefore necessary to intermittently machine the bottom roll to restore its surface and maintain sheet quality. When both rolls are driven by a single motor, this necessitates machining sound metal from the top roll to maintain uniform diameter of the two rolls. This unnecessarily shortens the life of the shell on the roll. This is avoided with a dual drive caster where the two rolls are independently driven. Light machining may be all that is required for dressing the surface of the top roll, and its shell may last much longer. This invention concerns control of casting speed in such a dual drive casting machine.

To maximize production rate, it is generally desirable to cast metal at the highest possible speed. The speed depends on many variables, including the width and thickness of the sheet being cast, the alloy being cast, roll surface condition, roll temperature, molten metal temperature, tension applied by the winder, and the like, as is well known to those operating such machines. A problem sometimes encountered when a caster is operated at too high a speed is sticking of the metal to the roll surface. Such sticking is intolerable since the sheet surface is damaged to the extent that the sheet is unusable. It is usually desirable, however, to operate the roll caster near the speed at which sticking may occur to maximize production.

A phenomenon known as microsticking has been observed. This seems to be temporary sticking in minor areas and is believed to be a precursor of more severe sticking, which is to be avoided. The usual remedy when microsticking or sticking occurs is to reduce roll speed until the problem is cured. It may thereafter be feasible to increase roll speed as operating variables change, to regain some or all of the former production rate.

Traditionally, casting machine operators have observed a variety of operating parameters for controlling casting. Such machines have been controlled manually with the operator observing motor current, roll separating force, metal temperature, roll current water temperature, sheet quality, etc. for controlling casting machine operating parameters, including speed. One important such parameter has been the casting machine motor current. An operator typically maintains a selected motor current for uniform operation. Sticking results in an increase in motor current to maintain casting speed and can be detected by observing current.

U.S. Pat. No. 4,501,315 describes a method of controlling a casting machine to avoid adhesion of the metal to the rolls. The method compares the frequency of variations of torque on one of the rolls with a reference frequency. When the variation frequency is greater than the reference frequency, operating parameters are changed to reduce the variation frequency.

It is desirable to provide a technique for controlling a roll caster based on parameters other than the frequency of variations of torque. It is particularly desirable to provide a technique appropriate for a dual drive casting machine. It is also desirable to provide a control technique that maximizes casting speed.

BRIEF SUMMARY OF THE INVENTION

There is, therefore, provided in practice of this invention a control system for a dual drive casting machine wherein the rotation of a slave motor on one roll is controlled by the rotation of a master motor for the other rol. A comparator compares the torque for driving the master roll with the torque for driving the slave roll. The speed of the master roll is decreased when the differential torque exceeds a selected high limit, which typically indicates sticking. A band pass filter connected to the comparator passes only changes in differential torque between higher and lower frequency limits. Means are provided for decreasing speed of the master roll when the differential torque passed by the band pass filter is greater than a selected magnitude. Alternatively, the speed of the master roll may be decreased when the rate of change of the differential torque passed by the band pass filter is greater than a selected magnitude.

Means are also provided for controlling current to drive the slave roll in relation to the current required to drive the master roll. In such an embodiment, torque on one of the rolls is monitored rather than differential torque between the rolls. Upon detection of sticking or microsticking to the slave roll, the system is switched to the speed mode of control when correction is made in the master speed control.

DRAWINGS

These and other features and advantages of the present invention will be better understood by reference to the following detailed description when considered in connection with the accompanying drawings wherein.

DESCRIPTION

Figure 1:
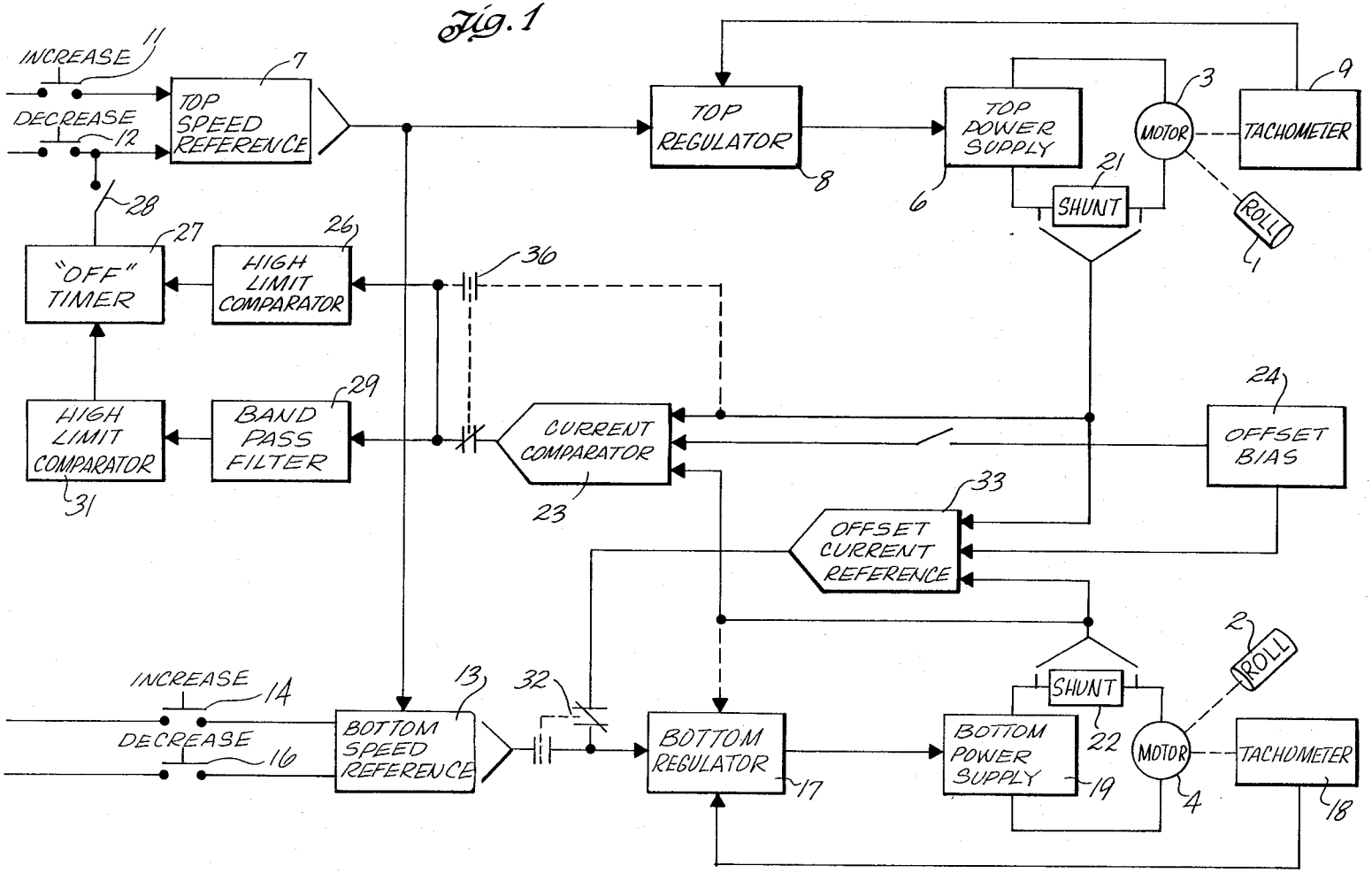
FIG. 1 is a block diagram of a control system constructed according to principles of this invention.

A dual drive casting machine comprises a top roll 1 and a bottom roll 2 illustrated schematically in the block diagram. The top roll is driven by a top direct current motor 3. Likewise the bottom roll is driven by a bottom DC motor 4. In this embodiment the top motor is a master and the bottom motor is a slave. That is, the bottom motor runs at a controllable percentage of the speed or current of the top motor. The speed difference is referred to as offset. Depending on roll diameters and desired operating conditions of the casting machine, the offset may be plus, minus or zero. That is, the bottom roll may rotate faster, slower or at the same speed as the top roll. In other embodiments, the bottom roll may be the master and the top roll the slave.

The top motor is driven by a top thyrister power supply 6. A conventional digital servo 7 provides a top speed reference signal to a top speed regulator 8. A tachometer 9 connected to the top motor provides a top speed feedback signal to the top regulator which in turn provides a speed control signal for the top power supply 6.

As suggested by the use of a digital servo 7 for the top speed reference, it is preferred to employ digital control devices in the system. Clearly analog devices may be employed if desired.

The top or master speed reference signal is set by the operator by means of two push buttons 11 and 12. Depressing the increase push button 11 gradually changes the top speed reference signal for increasing rotational speed of the motor and roll. Conversely depressing the decrease push button 12 decreases motor speed. Although illustrated as manual control of the master speed reference signal, the control may be replaced or supplimented by automatic controls.

A second digital servo 13 provides a bottom speed reference signal. The bottom servo is linked to the top speed reference signal so that the bottom speed reference signal is a function of the top speed reference signal. An increase push button 14 and decrease push button 16 permit the operator to increase or decrease the offset so that the bottom speed reference signal is a controlled percentage of the top speed reference signal.

The bottom speed reference signal is applied to a bottom regulator 17 which also receives a bottom speed feedback signal from a tachometer 18 coupled to the bottom motor 4. This regulator controls a bottom thyrister power supply 19 which provides direct current for operating the bottom motor.

A shunt 21 in the top motor current line provides a top motor current signal. Similarly, a shunt 22 in the bottom motor current line provides a bottom motor current signal. These two current signals are applied to a current comparator 23. An offset by a signal from a sensing circuit 24 is also applied to the current comparator to compensate for inherent current differences during steady state operation of the casting machine. Such current differences may arise from the differential speed between the top and bottom rolls or due to inherent differences even when the rolls are identical. It is noted, for example, that the current to drive the bottom roll is ordinarily greater than the current to drive the top roll even when the speeds are the same. The reason for this inherent difference has not been adequately explained.

The output of the current comparator 23 is applied to a high limit comparator 26. During steady state operation there is essentially no output from the current comparator. In the event of sticking of metal to either of the rolls, the current required to maintain that roll speed has a significant increase. This signal causes the high limit comparator to generate a string of digital pulses applied to the top speed reference decrease line by way of an "off" timer 27 and a switch 28. The switch 28 is closed during normal operation of the casting machine so that the control system can operate in the event of sticking or the like. The switch may be opened to disable the sticking sensing system during start up of the caster or significant changes in operating parameter.

Application of the string of digital pulses to the top speed reference 7 causes a decrease in the speed reference signal and hence a decrease in rotational speed of the top roll. Since the bottom roll is slaved to the top roll it too slows down.

When the casting machine is slowed, a short time is required to stabilize its operation. The "off" timer 27 therefore opens the connection between the high limit comparator and the speed reference decreasae line to disable the control system temporarily. The timer may leave the system off for an adjustable time interval such as, for example, 20 seconds or may be coupled to the tachometer to leave the system off for a given rolling distance such as, for example, 1/2 revolution of the casting roll. This gives time for the casting situation to stabilize before further changes are made in the speed.

The signal from the current comparator is also applied to a band pass filter 29. Typically, the band pass filter is set to exclude signals at a frequency less than about one half cycle per second and signals having a frequency greater than about ten cycles per second. Thus, the band pass filter excludes slow changes in the differential current between the two rolls and excludes high frequency transients which might interfere with practice of this invention.

Signals that pass the band pass filter are applied to a high limit comparator 31. If the differential current in this passed band is greater than a selected magnitude, the high limit comparator puts out a digital command to the top speed reference decrease line by way of the "off" timer 27 and switch 28. It is found that microsticking of metal to one of the rolls may cause an increase in differential current in the range that will pass the band pass filter with a high limit at ten Hertz and a low limit at one Hertz. When the magnitude of the passed signal is large enough, roll speed is decreased by the high limit comparator 31. Just as in the event of an adjustment of roll speed in the event of sticking it is desirable to permit the casting to stabilize before again sampling the differential current. Thus, the "off" timer is used to temporarily disable the control system upon receiving a signal from the high limit comparator 31.

Each of the high limit comparators 26 and 31 can be set to provide an output signal proportioned to the magnitude of the input signal from the current comparator 23. Thus, for example, upon receiving a signal of a selected magnitude a high limit comparator may put out a digital signal sufficient to cause a two percent decrease in rotational speed. In the event the differential current magnitude is somewhat larger, the high limit comparator may be set to reduce rotational speed four percent, for example. The magnitude of the reduction in speed is adjustable so that appropriate decreases can be made for the alloy casting speed, thickness, etc. involved in a given casting run.

By employing differential current between the two rolls of a casting machine, the sensitivity to microsticking is effectively doubled. It generally occurs in sticking and microsticking that the total current required to drive the casting machine stays roughly constant. The current to drive one roll increases while the other decreases. By measuring the differential current between the two rolls, changes in the total current, line voltage variations, and other extraneous influences are avoided.

It may be recognized that in the event of sticking, both high limit comparators may sense a differential current greater than the selected magnitude. It might happen, for example, that the high limit comparator 26 connected to detect sticking calls for a speed reduction greater than the speed reduction called for by the high limit comparator 31 connected to detect microsticking. Means are provided for giving priority to the signal from the high limit comparator 26 connected for detecting sticking over the high limit comparator 31 connected for detecting microsticking.

It may be desirable to employ a different detection of microsticking. In such an embodiment the signal through the band pass filter 29 is applied to a high level comparator 31 which differentiates the signal and gives an output signal for decreasing roll speed when the rate of change of differential current exceeds a selected magnitude. Otherwise, the system operates as hereinabove described.

It has also proven to be desirable in some casting processes to control the slave roll on the basis of current rather than speed. In fact, it is found that substantial increases in production rate can be achieved with current rather than speed control. In such an embodiment the system is switched to a current mode from a speed mode. In this condition the top roll is controlled by the top speed reference in the same manner as in the speed control mode. However, instead of a bottom speed feedback signal from the bottom motor being applied to the bottom regulator, a bottom current feedback signal is applied from the bottom shunt 22 to the bottom speed regulator 17 for controlling the bottom motor. This signal connection is indicated by a dashed line in the drawing.

Further, a coupled switch 32 is thrown to connect the output of an offset current reference 33 to the bottom regulator 17. The offset current reference signal combines the top motor current signal, bottom motor current signal and an offset bias signal for driving the bottom motor with a selected current offset from the current driving the top motor. As in the speed embodiment, this bias may be plus, minus or zero.

Surprisingly, it is found that by controlling current of the bottom motor as a function of the current required to drive the top motor, the casting speed may be increased as much as ten percent without deleterious consequences. There appears to be less likelihood of sticking when current feedback is used than when speed feedback is used. The increased casting speed, of course, results in higher productivity.

Sticking or microsticking can also be detected and remedied with the casting machine operating in the current mode. There are some differences from the control arrangement used when the casting machine is operated in the speed control mode. Switching of the system from speed control to current control also calls for switching the detection circuit by a coupled switch 36 which bypasses the current comparator 23 and applies the top motor current directly to the band pass filter 29 and the high limit comparator 26.

In the current control mode, the current of the bottom slave roll motor is maintained at a constant offset from the current of the top master roll motor. Thus, measurement of the differential current between the motors is not completely satisfactory for detecting sticking or microsticking. Differential current can be used when the time constants of the system are appropriate, however, it is preferred to monitor the current of the master roll only.

In such an embodiment, the current of the top motor is compared with a fixed value via the high limit comparator 26, and if the current changes more than a selected magnitude, sticking is indicated. Similarly, if the current changes more than a selected magnitude in the range passed by the band pass filter 29 (one half to ten Hertz), microsticking is indicated. The current is compared with current during a preceding time period of reasonable duration or with an arbitrarily selected current.

If the top roll motor current increases, bottom roll sticking is indicated and the control system reacts as described above for the speed control mode by decreasing the top speed reference.

On the other hand, if the top roll motor current decreases, top roll sticking is indicated. Similarly, if the top roll motor current shows a fluctuating decrease of a selected magnitude in the frequency range passed by the band pass filter, microsticking to the top roll is indicated. As in the speed control embodiment, rate of change of motor current may also be used to detect microsticking. In the event sticking or microsticking are detected, the control system reacts by first switching the bottom roll motor from the current regulation mode to the speed regulation mode so that the bottom roll speed is controlled at a selected speed offset from the top speed. In addition, the top speed reference, now controlling both motors, is decreased. After stability is achieved, the bottom roll may be switched back to the current mode.

It will be recognized that current required to drive the two motors is directly related to torque on these motors. Other measures of torque may be used; however, current is a measurement already made for monitoring by the casting machine operator. This makes its use in practice of this invention quite convenient.

Figure 2:
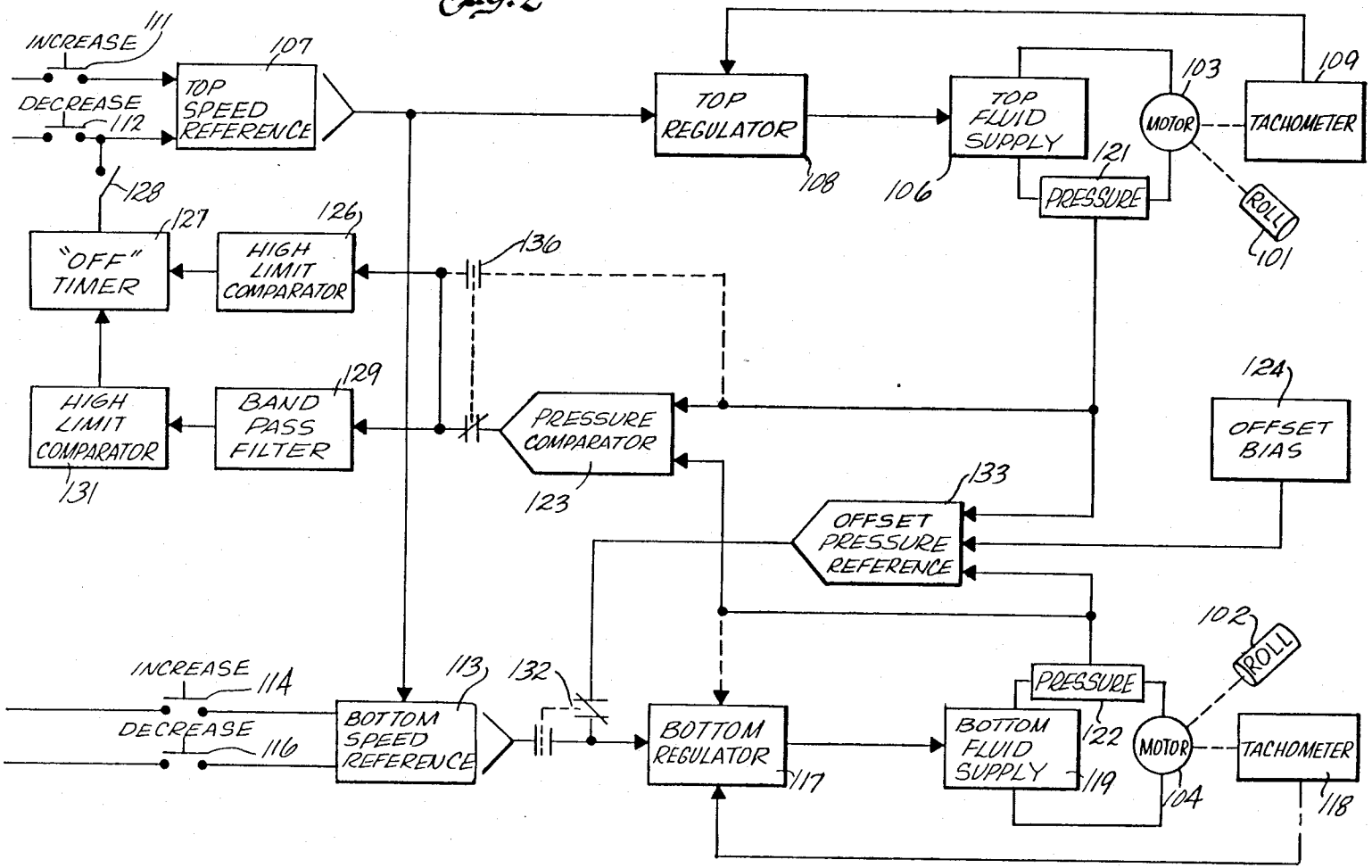
FIG. 2 is a block diagram of a control system like that in FIG. 1 but with hydraulic instead of electric motors.

It is also possible to drive the rolls of a dual drive casting machine with hydraulic rather than electric motors. Such an embodiment is illustrated in FIG. 2 which is nearly identical to the embodiment illustrated in FIG. 1, except that hydraulic motors 103 and 104 are used instead of the electric motors illustrated in FIG. 1. In FIG. 2 the same reference numerals are employed to identify the same elements as in FIG. 1, plus 100. Thus, for example, the top speed reference is identified with the reference numeral 7 in FIG. 1, and is identified with numeral 107 in FIG. 2. Consistent with use of the hydraulic motors, the power supplies for the motors are identified as fluid supplies 106 and 119. In such an embodiment pressure measurements are employed as an indication of torque and compared to produce signals for use in practice of this invention. Many other modifications and variations will be apparent to one skilled in the art and it is therefore to be understood that within the scope of the appended claims the invention may be practiced otherwise than as specifically described.

What is claimed is:

1. A control system for a dual drive casting machine having a master roll driven by a master motor, a slave roll driven by a slave motor, means for feeding molten metal into the nip of the rolls and means for withdrawing cast sheet from between the rolls, the control system comprising:

means for setting a desired rotational speed of the master motor;

means for controlling rotation of the slave motor at a selected offset from the master motor;

comparator means for comparing the torque for driving the master roll with the torque for driving the slave roll;

first means connected to the comparator means for decreasing speed of the master roll when the differential torque exceeds a selected high limit;

band pass means connected to the comparator means for excluding changes in differential torque at a rate greater than a given higher frequency and lower than a given lower frequency and passing changes in differential torque between the lower and higher frequencies; and second means for decreasing speed of the master roll when the differential torque passed by the band pass means is greater than a selected magnitude.

2. A control system as recited in claim 1 wherein the comparator means compares the current driving the slave motor with the current driving the master motor.

3. A control system as recited in claim 1 wherein the motors are hydraulic motors and the comparator means compares pressure of the hydraulic fluid.

4. A control system as recited in claim 1 wherein the means for decreasing speed comprises means for proportioning the magnitude of the decrease in speed to the magnitude of the differential torque.

5. A control system as recited in claim 1 comprising means for disabling the control system for an interval following a change in master motor speed.

6. A control system as recited in claim 1 wherein the first means for decreasing speed takes priority over the second means for decreasing speed when both the magnitude of differential torque exceeds its selected high limit and the differential torque passed by the band pass means is greater than its selected magnitude.

7. A control system as recited in claim 1 wherein the band pass means excluded changes in differential torque less than about one half cycle per second and greater than about ten cycles per second.

8. A control system for a dual drive casting machine having a master roll driven by a master motor, a slave roll driven by a slave motor, means for feeding molten metal into the nip of the rolls and means for withdrawing cast sheet from between the rolls, the control system comprising:

means for setting a desired rotational speed of the master motor;

means for controlling rotation of the slave motor at a selected offset from the master motor;

first means for decreasing speed of the master roll when a change in torque exceeds a selected high limit;

band pass means for excluding changes in torque at a rate greater than a given higher frequency and lower than a given lower frequency and passing changes in torque between the lower and higher frequencies; and second means for decreasing speed of the master roll when the rate of change of the torque passed by the band pass means is greater than a selected magnitude.

9. A control system as recited in claim 8 comprising comparator means for comparing the current for driving the master roll with the current for drivng the slave roll, the output of the comparator means being connected to the means for decreasing speed and the band pass means for controlling speed based on differential current between the master and slave roll motors.

10. A control system as recited in claim 9 wherein the motors are hydraulic motors and the comparator means compares pressure of the hydraulic fluid.

11. A control system as recited in claim 8 wherein the means for decreasing speed comprises means for proportioning the magnitude of the decrease in speed to the magnitude of the change in torque.

12. A control system as recited in claim 8 comprising means for disabling the control system for an interval following a change in master motor speed.

13. A control system as recited in claim 8 wherein the first means for decreasing speed takes priority over the second means for decreasing speed when both the magnitude of change in torque exceeds its selected high limit and the change in torque passed by the band pass means is greater than its selected magnitude.

14. A control system as recited in clain 8 wherein the band pass means excludes changes in torque less than about one half cycle per second and greater than about ten cycles per second.

15. A control system for a dual drive casting machine having a master roll driven by a master motor, a slave roll driven by a slave motor, means for feeding molten metal into the nip of the rolls and means for withdrawing cast sheet from between the rolls, the control system comprising:

means for setting a desired rotational speed of the master motor;

means for controlling the current of the slave motor at a selected offset from the current of the master motor;

comparator means for comparing the current for driving the master roll with a selected current;

means connected to the comparator means for decreasing speed of the master roll when the magnitude of change in compared current exceeds a selected high limit;

band pass means connected to the comparator means for excluding changes in current at a rate greater than a given higher frequency and lower than a given lower frequency and passing changes in current between the lower and higher frequencies; and second means for decreasing speed of the master roll when the current passed by the band pass means is greater than a selected magnitude.

16. A control system as recited in claim 15 wherein the means for decreasing speed comprises means for proportioning the magnitude of the decrease in speed to the magnitude of the change in current.

17. A control system as recited in claim 15 comprising means for disabling the control system for an interval following a change in master motor speed.

18. A control system as recited in claim 15 wherein the first means for decreasing speed takes priority over the second means for decreasing speed when both the magnitude of changed current exceeds its selected high limit and the magnitude of changed current passed by the band pass means is greater than its selected magnitude.

19. A control system as recited in claim 15 wherein the band pass means excludes changes in current less than about one half cycle per second and greater than about ten cycles per second.

20. A dual drive roll casting machine comprising:

a master roll;

a master motor coupled to the master roll for rotating the master roll at a selected speed;

a slave roll;

a slave motor coupled to the slave roll for rotating the slave roll;

means for introducing molten metal into the nip between the rolls;

means for withdrawing cast sheet from between the rolls; and an adjustable offset servo system connected to the slave motor and including feedback from the slave motor for controlling rotation of the slave motor at a selected offset from the master motor.

21. A casting machine as recited in claim 20 wherein the feedback comprises a speed signal for controlling the speed of the slave roll at a selected percentage of the speed of the master roll.

22. A casting machine as recited in claim 20 wherein the feedback comprises a current signal for maintaining a slave motor current at a selected percentage of the master motor current.

23. A casting machine as recited in claim 22 further comprising:

means for detecting microsticking of metal to the master roll; and means for switching control of the slave roll for controlling speed of the slave motor at a selected offset from the speed of the master roll upon detecting microsticking and at the same time decreasing speed of the master motor.

24. A casting machine as recited in claim 22 further comprising:

means for detecting sticking of metal to one of the rolls: and means for decreasing speed of the master roll upon detecting sticking.

25. A casting machine as recited in claim 24 comprising means for also switching control of the slave roll for controlling speed of the slave roll at a selected offset from the speed of the master roll upon detecting sticking of metal to the master roll.

26. A control system for a dual drive casting machine having a master roll driven by a master motor, a slave roll driven by a slave motor, means for feeding molten metal into the nip of the rolls and means for withdrawing cast sheet from between the rolls, the control system comprising:

means for setting a desired rotational speed of the master motor;

means for controlling rotation of the slave motor at a selected offset from the master motor;

means for sensing the current for driving the master roll;

first means for decreasing speed of the master roll when a change in current exceeds a selected high limit;

band pass means for excluding changes in current at a rate greater than a given higher frequency and lower than a given lower frequency and passing changes in current between the lower and higher frequencies; and second means for decreasing speed of the master roll when change in current passed by the band pass means is greater than a selected magnitude.

27. A control system as recited in claim 26 wherein the means for decreasing speed comprises means for proportioning the magnitude of the decrease in speed to the magnitude of the change in current.

28. A control system as recited in claim 26 comprising means for disabling the control system for an interval following a change in master motor speed.

29. A control system as recited in claim 26 wherein the first means for decreasing speed takes priority over the second means for decreasing speed when both the magnitude of change in current exceeds its selected high limit and the change in current passed by the band pass means is greater than its selected magnitude.

30. A control system as recited in claim 26 wherein the band pass means excludes changes in current less than about one half cycle per second and greater than about ten cycles per second.

31. A method for controlling a dual drive casting machine having a master roll driven by a master motor, a slave roll driven by a slave motor, means for feeding molten metal into the nip of the rolls and means for withdrawng cast sheet from between the rolls, the method comprising the steps of:

setting a desired rotational speed of the master motor;

controlling rotation of the slave motor at a selected offset from the master motor;

sensing torque driving the master roll;

decreasing speed of the master roll when a change in torque exceeds a selected high limit;

sensing changes in torque at a rate between a given higher frequency and a given lower frequency; and decreasing speed of the master roll when the rate of change of the torque between the lower and higher frequencies is greater than a selected magnitude.

32. A method as recited in claim 31 comprising the steps of:

sensing the current for driving the master motor;

sensing the current for driving the slave motor; and controlling the speed of the master roll based on differential current between the master and slave roll motors.

33. A method as recited in claim 31 comprising proportioning the magnitude of the decrease in speed to the magnitude of the change in torque.

34. A method as recited in claim 31 comprising disabling the control system for an interval following a change in master motor speed.

35. A method as recited in claim 31 wherein the lower frequency is about one half cycle per second and the higher frequency is about ten cycles per second.

* * * * *

UNITED STATES PATENT AND TRADEMARK OFFICE

CERTIFICATE OF CORRECTION

PATENT NO. : 4,727,927

DATED : March 1, 1988

INVENTOR(S) : Stephen E. Popik

It is certified that error appears in the above-identified patent and that said Letters Patent is hereby corrected as shown below:

Column 2, line 52, "rol" should be -- roll --;
Column 4, line 35, "decreasae" should be -- decrease --;
Column 8, lines 16, 17, 21, "current" should be -- torque --;
Column 8, line 17, "drivng" should be -- driving --;
Column 9, line 54, ":" should be -- ; --;
Column 10, line 39, "withdrawng" should be -- withdrawing --.

Signed and Sealed this

Twenty-seventh Day of September, 1988

*Attest:*

DONALD J. QUIGG

*Attesting Officer*

*Commissioner of Patents and Trademarks*

Disclaimer 4,727,927.—*Stephen E. Popik*, Riverside, Calif. CASTING MACHINE CONTROL. Patent dated Mar. 1, 1988. Disclaimer filed May 14, 1990, by the assignee, Hunter Engineering Company, Inc.

Hereby enters this disclaimer to claims 15 through 19 and 22 through 25 of said patent.

[ *Official Gazette August 14, 1990* ]